US006050444A

United States Patent [19]

Sugg

[11] Patent Number: 6,050,444

[45] Date of Patent: Apr. 18, 2000

[54] CONSUMABLE BEVERAGE DISPENSER WITH ONE-WAY VALVE

[76] Inventor: James Wesley Sugg, 5730 Gene Sarazen Dr., Braselton, Ga. 30517

[21] Appl. No.: 09/120,839

[22] Filed: Jul. 22, 1998

[51] Int. Cl.[7] ..... B65D 77/28

[52] U.S. Cl. ..... 220/707; 215/229; 215/388; 220/705; 220/710; 220/714; 222/1; 229/103.1

[58] Field of Search ..... 220/710, 705, 220/714, 707; 215/388, 11.4, 11.5, 311, 229; 222/105, 494, 499, 522, 525, 529; 229/103.1

[56] References Cited

U.S. PATENT DOCUMENTS

| | | | |
|---|---|---|---|
| Re. 32,354 | 2/1987 | Savage | 222/499 X |
| 1,813,285 | 7/1931 | Galetschky . | |
| 2,094,268 | 9/1937 | Friedman | 215/388 X |
| 2,676,605 | 4/1954 | Meredew | 220/721 X |
| 2,756,740 | 7/1956 | Deane . | |
| 2,879,785 | 3/1959 | Vesterdal et al. | 220/723 X |
| 2,998,028 | 7/1961 | Rohde . | |
| 3,087,655 | 4/1963 | Scholle | 222/105 X |
| 3,349,987 | 10/1967 | Weitzner . | |
| 3,438,527 | 4/1969 | Gamblin, Jr. . | |
| 3,799,914 | 3/1974 | Schmit et al. . | |
| 3,895,742 | 7/1975 | Wulbern . | |
| 4,196,747 | 4/1980 | Quigley et al. . | |
| 4,463,779 | 8/1984 | Wink et al. . | |
| 4,544,087 | 10/1985 | Modig . | |
| 4,629,098 | 12/1986 | Eger . | |
| 4,718,778 | 1/1988 | Ichikawa . | |
| 4,739,905 | 4/1988 | Nelson . | |
| 4,964,852 | 10/1990 | Dunning et al. | 222/525 X |
| 4,998,990 | 3/1991 | Richter et al. | 222/105 X |
| 5,060,833 | 10/1991 | Edison et al. . | |
| 5,150,811 | 9/1992 | Kelston | 220/710 |
| 5,178,300 | 1/1993 | Haviv et al. . | |
| 5,188,261 | 2/1993 | Butters . | |
| 5,232,110 | 8/1993 | Purnell | 215/311 X |
| 5,301,858 | 4/1994 | Hollander . | |
| 5,358,142 | 10/1994 | Holmes . | |
| 5,437,389 | 8/1995 | Kaufman et al. . | |
| 5,474,193 | 12/1995 | Larsson et al. | 215/11.4 X |
| 5,522,524 | 6/1996 | Nmngani . | |
| 5,553,726 | 9/1996 | Park | 215/11.4 |
| 5,584,285 | 12/1996 | Salter et al. . | |
| 5,647,511 | 7/1997 | Bond | 222/105 |
| 5,687,872 | 11/1997 | Nmngani . | |

*Primary Examiner*—Allan N. Shoap
*Assistant Examiner*—Joe Merek
*Attorney, Agent, or Firm*—Kennedy Coverington Lodbell & Hickman, LLP

[57] ABSTRACT

A consumable beverage dispenser is provided having a collapsible beverage container, a valve assembly, and a flexible tube or straw. The collapsible beverage container has at least one opening and the valve assembly is secured to the container at the opening. The valve assembly includes a flexible diaphragm disposed across the flow path such that beverage flow is permitted only outwardly from the container. The flexible tube extends outwardly from the valve assembly. When a user exerts sucking action on the end of the flexible tube, beverage is made to flow from the container out through the one-way valve assembly and into the flexible tube. As beverage is withdrawn, the container collapses and, when the user stops drinking, the flexible diaphragm closes to prevent air and back flow from entering the container. In one embodiment, the flexible tube is slidable within the valve assembly between an open and a closed position. In the closed position, the flexible tube secures the flexible diaphragm to the valve seat and thereby prevents fluid flow through the valve assembly. In the open position, the flexible tube is spaced from the flexible diaphragm and thus beverage can flow through the valve assembly and out through the flexible tube in response to sucking action exerted on the end of the flexible tube by a user.

19 Claims, 4 Drawing Sheets

CONSUMABLE BEVERAGE DISPENSER WITH ONE-WAY VALVE

FIELD OF THE INVENTION

The present invention relates to beverage dispensers and more particularly to a collapsible beverage dispenser having a one-way valve.

BACKGROUND OF THE INVENTION

There are many different types of consumable beverage dispensers and one popular type consists of a liquid container having an attached flexible tube or straw. When designing such a beverage dispenser, there are several desirable qualities. The dispenser should be portable and able to provide beverage to a user without regard to the height above ground of the dispenser relative to the user. A person should also be able to drink from such a dispenser even if the dispenser is not exactly upright and even if the dispenser is located below a person's mouth level as might be the case if the person were holding the dispenser in their hand. Moreover, the beverage dispenser should be easy to use, without elaborate flow mechanisms and valves.

It is also desirable that a consumable beverage dispenser prevent air and back flow from entering the dispenser between sips. If air does enter the dispenser between sips, then the user must first evacuate the air in the container during subsequent sips before obtaining beverage from the container. If back flow enters the dispenser between sips, then there is a possibility of contaminating the beverage remaining in the container. It would also be advantageous for such a portable drink dispenser to be closable so that a user could drink from the dispenser and then seal the dispenser for later use.

Heretofore, numerous beverage dispensers having an attached straw have been designed; however, none of those designs completely embodies all of the desirable qualities discussed above. An early example of a drinking device with an attached hose is found in U.S. Pat. No. 2,756,740 to Deane, which discloses a drinking device for hospital patients. This device consists of an inverted bottle having a liquid flow tube extending from the "bottom" of the inverted bottle. A valve assembly is located where the tube terminates near a mouthpiece. To drink from this device, a hospital patient must grab the valve device and exert pressure on a valve plunger to open the valve, at which point the patient can then consume the beverage inside the bottle.

Similarly, U.S. Pat. No. 4,629,098 to Eger discloses a portable liquid dispenser also having a plunger type valve located near a mouthpiece. In the Eger dispenser, however, the liquid is pressurized to force it through a drinking tube connected at the top of the container.

Containers such as those disclosed in Deane and Eger are disadvantageous in two respects. First, these devices require a user to depress a plunger on the valve assembly. Thus, they are inconvenient to use and cannot be used by people not having full use of at least one hand, such as those paralyzed or injured. Second, since these devices utilize a rigid liquid container, they can only be used in their proper orientation. That is, the Deane device must be inverted and the Eger device must be upright, as the drinking tube in Deane attaches to the inverted "top" of the bottle and the intake for the drinking tube in Eger is located near the bottom of its container.

Flexible containers overcome some of the disadvantages of rigid containers and indeed flexible containers with attached drinking tubes have often been designed for use in sports. For example, U.S. Pat. No. 5,060,833 to Edison et al. and U.S. Pat. No. 5,358,142 to Holmes disclose flexible bladders having attached drinking tubes for use primarily in bicycling. The Holmes drinking bag is mouth-pressurized and, in one embodiment, a rubberized bite-valve is disposed at the end of the drinking tube. The Edison apparatus includes a collapsible water container located within a backpack device and also utilizes a bite-valve at the end of the drinking tube. While these devices allow for hands-free operation, they are disadvantageous in that they require users to hold a valve mechanism inside their mouths for prolonged periods.

As the above discussion shows, it would be desirable to have a portable consumable beverage dispenser that could be used in any orientation and without the need for biting or-otherwise pushing on a valve mechanism to take a drink. Additionally, it would also be desirable if such a dispenser could prevent back flow and air entry into the beverage container and also be resealable.

SUMMARY OF THE INVENTION

The present invention overcomes the problems identified above through the provision of a beverage dispenser having a diaphragm-type one-way valve disposed between a collapsible beverage container and a flexible tube, or straw. More particularly, a preferred embodiment of the present includes a flexible tube extending from a valve assembly located at the opening of a collapsible beverage container. The valve assembly has a flexible diaphragm held by a retaining member across the outward fluid flow path of the dispenser such that beverage can only flow outwardly therefrom. The flexible tube can be bent to a desired position.

When a user sucks on one end of the flexible tube, the diaphragm moves slightly and bends to allow beverage to flow out of the container, past the diaphragm, and through the flexible tube into the user's mouth. As beverage is withdrawn from the container, the container collapses. When the user stops sucking on an attached flexible tube, the diaphragm returns to its normal position, thereby preventing air and back flow from entering the container after the user finishes drinking. Thus, the next time the user drinks from the flexible tube straw, the user does not ingest air from inside the container before intaking beverage.

To prevent the container from blocking the beverage flow path out of the container when the container collapses, the present invention also provides for a spacing member that extends from the valve assembly into the collapsible container. As the container collapses when beverage is withdrawn, the spacing member ensures that the container does not get drawn into the valve assembly and block beverage flow therethrough. The spacing member can be a ribbed semicircular member having a portion of its outer periphery cut out. The cut-out portion and the ribs ensure that a path remains open for beverage to flow to the valve assembly even when the collapsible container collapses around the spacing member.

The present invention also provides a unique closure in which the one-way diaphragm-type valve can be shut to prevent beverage from leaking out of the container when not in use. In this closure, the proximate end of the flexible tube is enclosed within the valve assembly and the flexible tube is slidable within the valve assembly between two positions. In the first or closed position, the proximate end of the flexible tube is adjacent the flexible diaphragm and prevents the diaphragm from opening. The proximate end of the tube is held in this position by the frictional engagement of a receiving cavity in the tube and a retaining member adjacent the diaphragm. In the second or open position, the proximate end of the flexible tube is pulled away from the diaphragm and thus the diaphragm allows beverage flow outwardly from the container and into the flexible tube. The proximate end of the tube is held in the open position by the frictional engagement of a protrusion on the proximate end of the tube with a detent in the valve assembly housing. Only minimal force on the flexible tube is required to move the tube between the first and second positions. In this closure, a spacing member can also be provided to ensure that the collapsible container does not block the valve assembly and prevent beverage flow out of the container as the container collapses.

Advantageously, the present invention provides a consumable beverage dispenser that is easy to use and that can be used regardless of the orientation of the dispenser. Because the diaphragm-type valve is activated by suction, a user need merely suck on a straw and does not have to hold a valve mechanism in his or her mouth and bite down to drink. Nor does a user have to squeeze the beverage container or manually open a valve in order to drink from the beverage dispenser of the present invention. Because the valve assembly is located at the container opening and the diaphragm valve prevents air from entering the container, the beverage dispenser of the present invention can be used regardless of its orientation. When consumption is no longer desired, the collapsible container of the present invention can be closed to prevent leakage while still preventing air from entering the container. Other advantages of the present invention will become apparent upon reading the following detailed description and appended claims, and upon reference to the accompanying drawings.

BRIEF DESCRIPTION OF THE DRAWINGS

For a more complete understanding of the present invention, reference should now be had to the embodiments described below and illustrated in greater detail in the accompanying drawings, which are not necessarily to scale.

DETAILED DESCRIPTION OF THE INVENTION

The present invention will be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete and will fully convey the scope of the invention to those skilled in the art.

Figure 1:
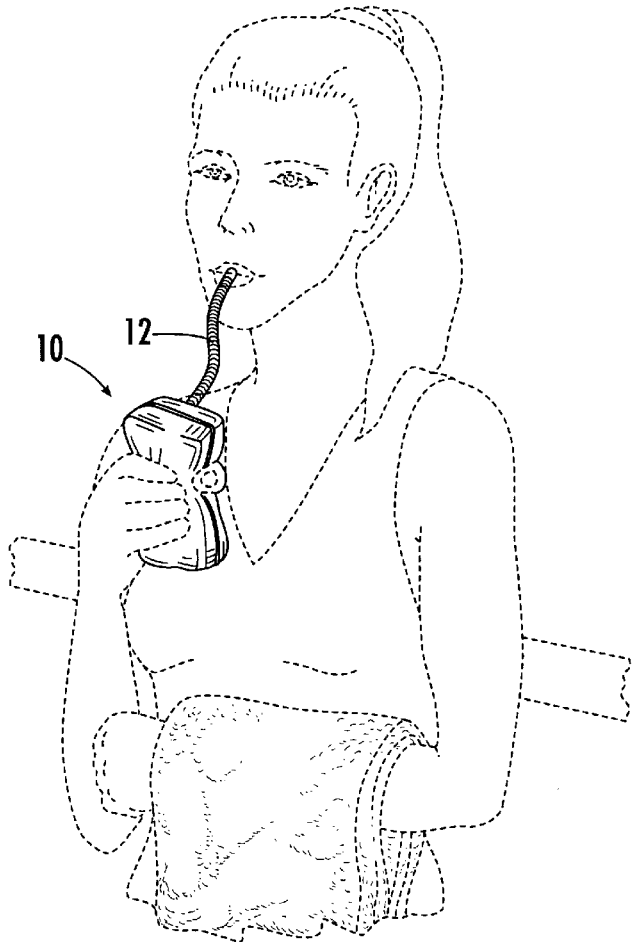
FIG. 1 is a perspective schematic view showing the consumable beverage dispenser of the present invention in use.
Figure 2:
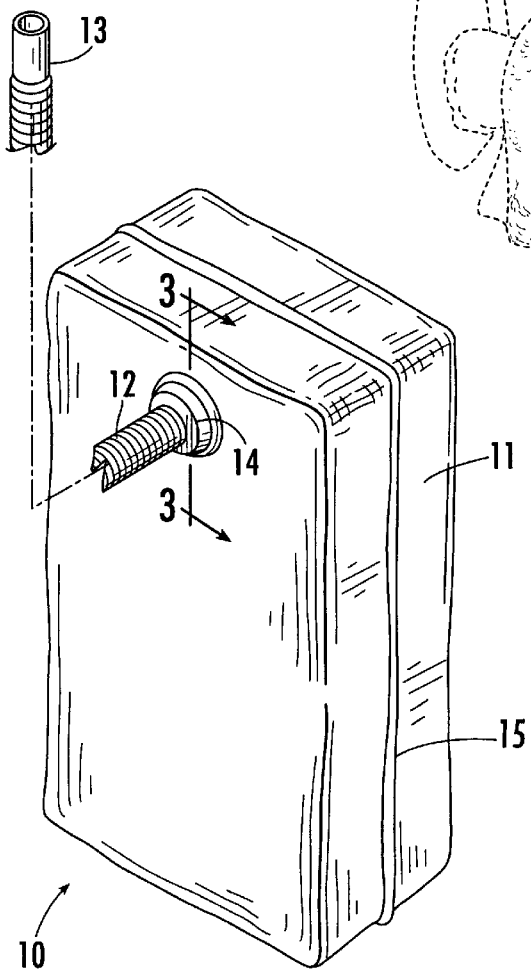
FIG. 2 is a perspective view of the consumable beverage dispenser of the present invention with the flexible tube shown in a fragmentary view.

As shown in FIGS. 1 and 2, the consumable beverage dispenser of the present invention, shown generally by the numeral 10, comprises a collapsible beverage container 11, a flexible tube 12 and a valve assembly 14. The dispenser is portable and may be used by anyone. While FIG. 1 illustrates that the present invention is particularly suitable for use before or during exercise, the invention is certainly not limited to such use. It may also be used, for example, in hospitals and medical care facilities to administer a predetermined volume of liquids to bedridden or other patients. Moreover, while the user in FIG. 1 is shown squeezing the collapsible container, it is not necessary that a container be squeezed to use. In fact, it is not even necessary that the collapsible container be held at all. A bedridden patient, for example, may use the beverage dispenser of the present invention by placing the container on the bed next to him or her and sucking from the flexible tube.

FIG. 2 illustrates a particularly advantageous design of the present invention wherein the valve assembly 14 is secured at the opening of the collapsible container 11 and the flexible tube 12 extends from the valve assembly terminating in a distal end 13.

The collapsible beverage container 11 may be made out of any material that is flexible, waterproof, and substantially gas impermeable. The container material may be formed from a single piece or, as illustrated in FIG. 2, the container may be made from two separate pieces of material that are sealed together, thermally or otherwise, to create a seam 15. Once formed, the container is pre-filled with beverage. While FIG. 2 shows a container having only one opening, the present invention also contemplates a collapsible container having more than one opening, as may be utilized for example in an embodiment having the valve assembly at one opening and a separate opening which is used for filling the container and then sealed. Also, different sizes of collapsible containers may be manufactured which hold different predetermined volumes of beverage as may be useful in a medical setting when monitoring a patient's volume of fluid intake.

The flexible tube, or straw, of the present invention may be made of any suitable material. The flexible tube may be smooth or have an accordion design as illustrated in FIGS. 1 and 2. A particularly advantageous feature of the flexible tube is that it has memory, i.e., once bent into a desired position the flexible tube remains in that shape. Thus, the flexible tube may be positioned adjacent to the collapsible container during shipment and then bent by a user into a desired shape for drinking. A wire or other reinforcing material may also be incorporated in the flexible straw for structural support or resiliency.

Figure 3:
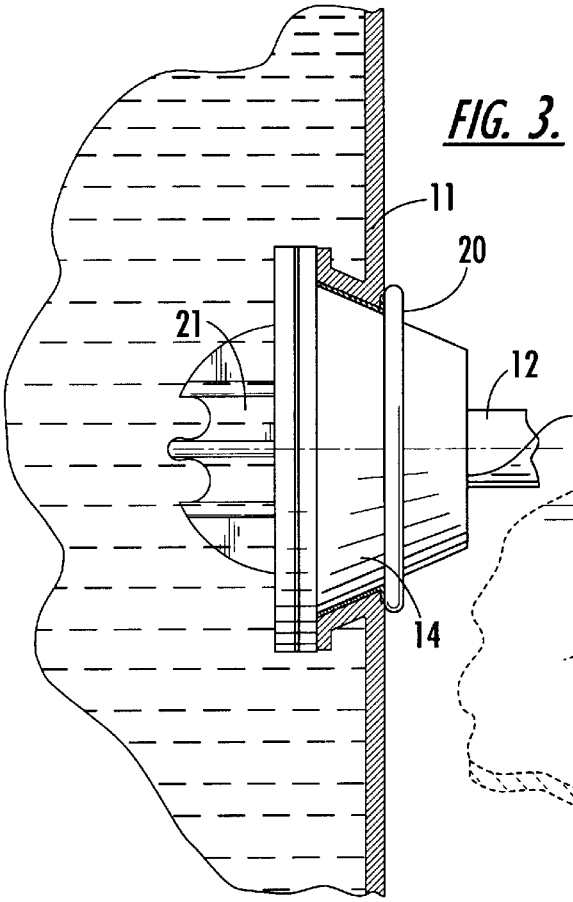
FIG. 3 is a partial cross-sectional view showing the valve assembly of one embodiment of the present invention disposed in an opening in a collapsible beverage container taken along the line 3—3 in FIG. 2.

FIG. 3 illustrates the valve assembly 14 of one embodiment of the present invention secured in the opening of a collapsible beverage container 11. The collapsible container 11 is secured to the valve assembly in a watertight manner as may be done with adhesives or other bonding techniques. A circumferential ridge 20 on the outside of the valve assembly 14 assists in positioning the valve assembly in the opening of the collapsible container.

In this embodiment, the proximate end 16 of the flexible tube 12 is secured to the valve assembly 14 and thus beverage in the collapsible beverage container can flow through the valve assembly and out through the flexible tube. Also shown in FIG. 3 is the spacing member 21 which extends from the valve assembly 14 into the collapsible container 11. The function and structure of the spacing member is discussed in more detail below.

Figure 4:
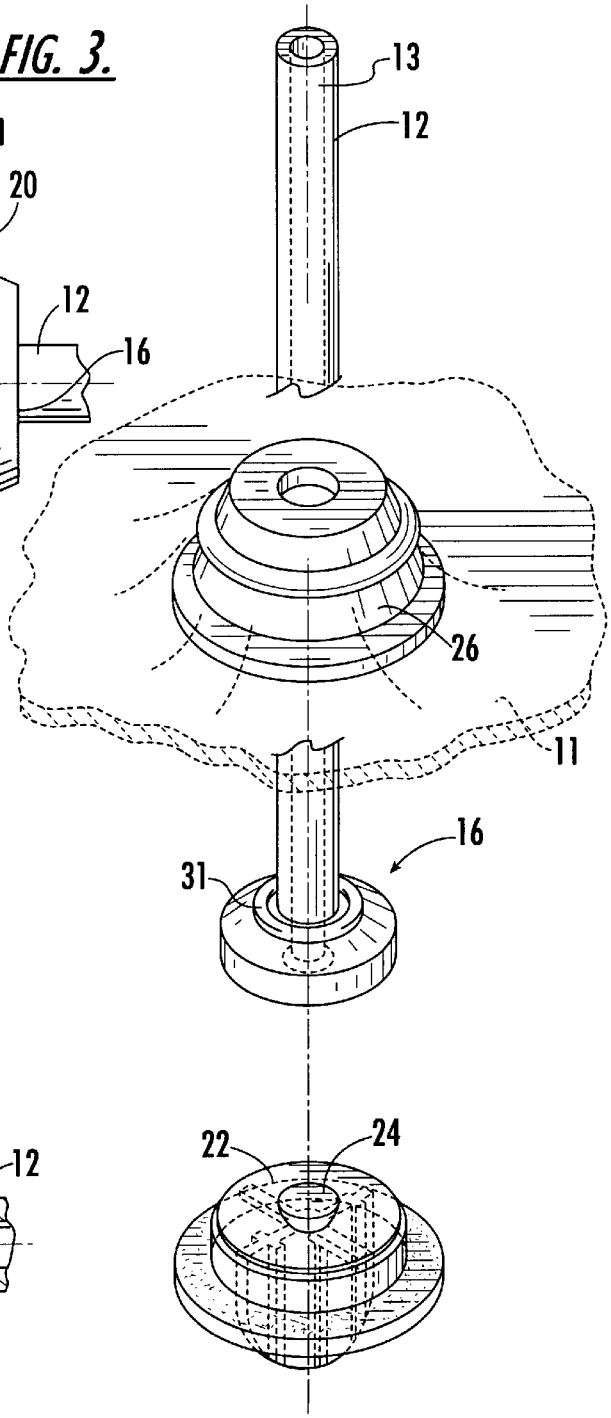
FIG. 4 is an exploded perspective view of another embodiment of the present invention.

FIG. 4. illustrates an exploded view of another embodiment of the present invention wherein the proximate end 16 of the flexible tube 12 is inside the valve assembly and the flexible tube slidably engages the valve housing 26 of the valve assembly. In this view, the flexible diaphragm 22 and the retaining member 24 are clearly visible, as is the annular protrusion 31 on the proximate end 16 of the flexible tube. In this embodiment, the flexible tube slides between a first position, or closed position, and a second position, or open position.

Figure 5:
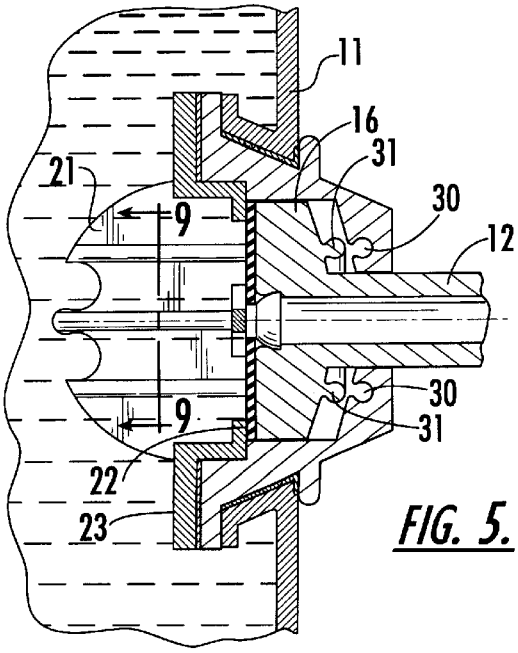
FIG. 5 is a sectional view of one embodiment of the present invention showing the flexible tube in a first position.

FIG. 5 illustrates the first position of the flexible tube 12. In this position, a receiving cavity on the proximate end 16 of the flexible tube engages the retaining member 24 to secure the flexible diaphragm 22 against the valve seat 23. The valve is thus closed and beverage cannot flow through the valve assembly. Also shown in FIG. 5, is a detent 30 in the valve housing 26 and a corresponding protrusion 31 on the proximate end 16 of the flexible tube.

Figure 6:
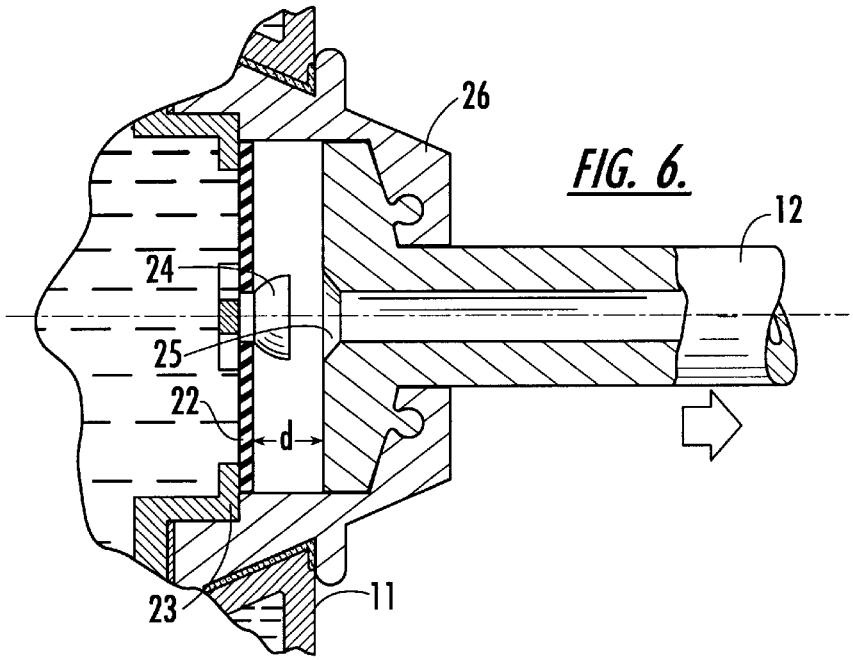
FIG. 6 is a sectional view of one embodiment of the present invention showing the flexible tube in a second position.

When a user pulls on the flexible tube 12, the proximate end 16 moves away from the flexible diaphragm 22 as shown in FIG. 6. Eventually, the protrusion 31 engages the detent 30 to secure the flexible tube in the second or open position. Also shown in FIG. 6 is the retaining member 24 and the receiving cavity 25 which, as discussed immediately above, cooperate to hold the flexible tube in the first position.

When the flexible tube is pulled to the second or open position, beverage can be made to flow from the container through the valve assembly and out the central passageway 32 in the flexible tube when a user exerts sucking action on the distal end of the flexible tube. The beverage flow path is illustrated generally by the arrows in FIG. 7 and the numeral 33.

Figure 7:
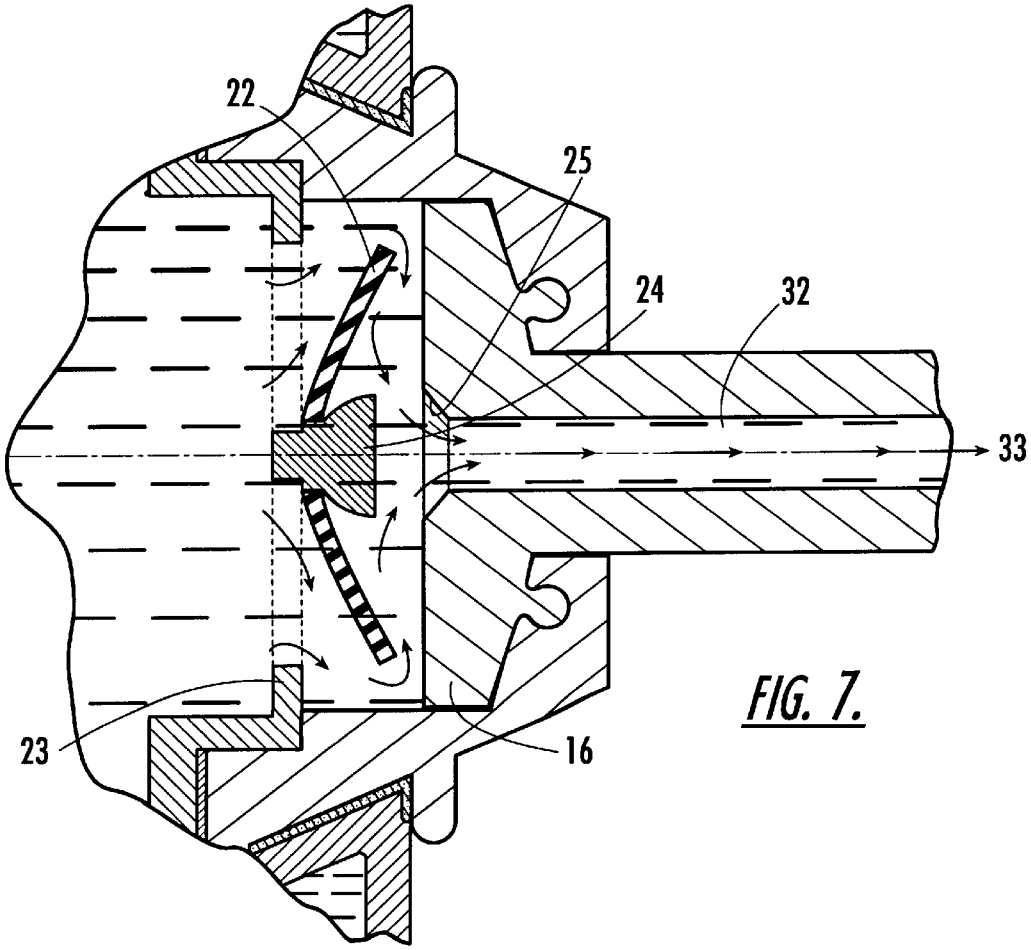
FIG. 7 is a sectional view of one embodiment of the present invention with the flexible tube in a second position and showing the outward beverage flow path.

The flexible diaphragm 22 of the present invention can be made from rubber or any other suitable material. While the flexible diaphragm can move slightly on the retaining member 24, the diaphragm is also capable of bending as shown in FIG. 7. Importantly, the diaphragm of the present invention is substantially gas impermeable so that when the diaphragm rests on the valve seat, i.e. when the valve is closed, air is not allowed to enter the collapsible container through the flexible diaphragm. The flexible diaphragm also prevents back flow into the container and therefore reduces the chance of contaminating the beverage inside the container.

The gas impermeability of the flexible diaphragm makes the present invention user friendly because, as the user sucks on the flexible tube, beverage is withdrawn and the collapsible container collapses. When the user stops sipping, the flexible diaphragm closes against the valve seat to prevent air and back flow from entering the container. Thus, when the user takes a subsequent sip, the user does not have to evacuate air from the container before beverage flows out. A suitable flexible diaphragm and retaining member are disclosed in U.S. Pat. No. 5,584,285 to Salter, et al. for use in a nebulizer device.

The distance d between the flexible diaphragm 22 and the proximate end 16 of the flexible tube in the second position should be the minimum distance required for the proximate end to clear the retaining member 24 and to ensure adequate space for the flexible diaphragm to bend. This is because beverage remaining in this area when the flexible tube is moved from the second position to the first position will necessarily be forced into the central passageway and thereby leak from the distal end of the flexible tube if not consumed by the user. Minimizing the distance d to the minimum necessary to achieve adequate flow minimizes the amount of liquid remaining in this area and hence minimizes the amount of possible leakage when transitioning between the open to closed position.

Also, the engagement between the receiving cavity and retaining member, and the engagement between the detent and protrusion, should be the minimum necessary to hold the flexible tube in place. This makes it easy to move the flexible tube between the first and second positions.

Figure 8:
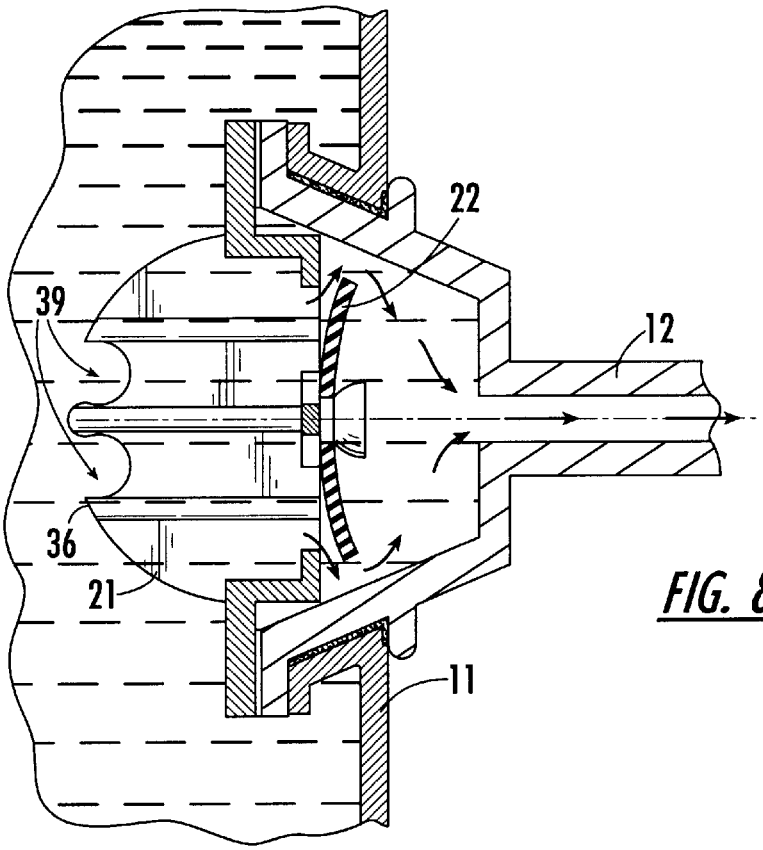
FIG. 8 is a sectional view of one embodiment of the present invention showing the outward beverage flow path.
Figure 9:
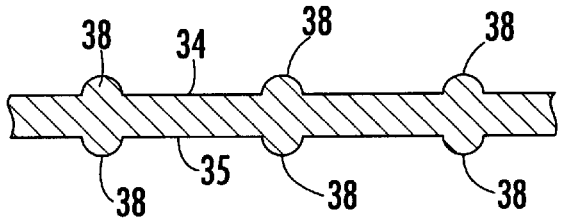
FIG. 9 is a cross-sectional view of the spacing member of the present invention, taken along the line 9—9 in FIG. 5.
Figure 10:
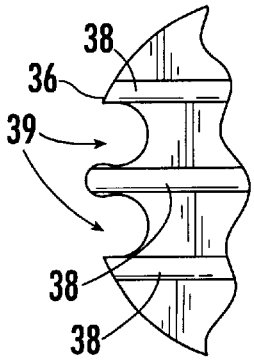
FIG. 10 is a side view of a portion of the spacing member of the present invention.

FIGS. 8–10 illustrate the spacing member 21 of the present invention. Although FIG. 8 illustrates the spacing member 21 in the embodiment of the present invention wherein the flexible tube 12 is fixed, it should be noted that the spacing member may also be used in the embodiment of the present invention in which the flexible tube is slidable within the valve assembly.

The purpose of the spacing member 21 is to prevent the collapsible container from blocking outward beverage flow through the valve assembly when the collapsible container collapses as beverage is withdrawn. Because air is not allowed into the container as beverage is withdrawn, the possibility exists that the collapsible container may be forced into the valve assembly as a user drinks from the dispenser and thereby prevent beverage flow out of the valve assembly. The spacing member prevents this from occurring.

The rigid spacing member 21 may be formed substantially in the shape of a semi-circle having a periphery 36 with at least one notch 39 removed therefrom. As illustrated in FIG. 9, the spacing member 21 comprises a first surface 34 and a second surface 35, each of which has at least one elongate protrusion 38 on it. A suitable relationship between the elongate protrusions 38 and the notches 39 is shown in FIG. 10. This arrangement ensures that beverage is free to flow through the valve assembly even if the collapsible container collapses to a point where it is adjacent the spacing member.

In an advantageous configuration of the present invention, the rigid spacing member 21 extends from the flexible diaphragm 22 into the collapsible container for most of the width of the collapsible container. In this way, the spacing member can also provide resistance when the collapsible container is lying on a surface and the flexible tube is pushed from the open to the closed position.

As the above discussion illustrates, the present invention provides a consumable beverage dispenser having a one-way valve that is activated in response to sucking action on the distal end of a flexible tube or straw. This dispenser is easy to use and does not require manual opening of a valve or placement of a valve mechanism inside of a user's mouth. Rather, when a user sucks on the distal end of the flexible tube, beverage is made to flow out of the collapsible container and through the valve assembly having a flexible diaphragm. When the user stops sucking, the flexible diaphragm closes to prevent air or back flow from entering the collapsible container.

The user may then push the flexible straw inwardly toward the valve assembly until the receiving cavity engages the retaining member, at which point the dispenser is closed and beverage will not leak from the container through the flexible tube. When the user again desires to drink, the user can pull the flexible tube outwardly from the valve assembly until the protrusion on the proximate end of the flexible tube engages the detent in the valve housing, at which point the valve assembly is "open" and the user may again begin drinking from the dispenser. Eventually, the collapsible container will collapse to a point at which the user will have consumed substantially all of the beverage from the container.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A consumable beverage dispenser, comprising:

a collapsible beverage container having at least one opening;

a flexible tube having a distal end and a proximate end; and a valve assembly adjacent said opening and operably connected to the proximate end of said flexible tube such that said valve assembly, said opening, and said flexible tube define a beverage flow path out of said container;

said valve assembly having a flexible diaphragm disposed across the flow path permitting beverage flow only outwardly from said container and a generally semicircular disk spacing member having a radius axially extending into said collapsible container and defining a first surface having at least one elongate raised area protruding therefrom, a second surface having at least one elongate raised area protruding therefrom, and a periphery defining at least one notch, such that beverage present in said container is made to flow out of said container through said valve assembly and through said flexible tube when sucking action is exerted by a user on the distal end of said flexible tube and wherein said spacing member prevents said collapsible container from blocking the outward beverage flow of beverage through said valve assembly as beverage is withdrawn and said collapsible container collapses.

2. A consumable beverage dispenser as defined in claim 1 wherein said flexible tube retains its position after being bent into a desired position.

3. A consumable beverage dispenser as defined in claim 1, further comprising a rigid outer container enclosing said collapsible beverage container, said rigid outer container defining at least one hole through which at least a portion of said valve assembly extends.

4. A consumable beverage dispenser, comprising:

a collapsible beverage container having at least one opening;

a valve assembly in communication with said opening, said valve assembly comprising a valve seat, a valve housing having a hole therethrough, and a flexible diaphragm disposed on said valve seat within said valve housing and permitting beverage flow only outwardly from said container; and a flexible tube having a distal end and a proximate end and being slidably received in the hole in said valve housing such that said distal end of said flexible tube is outside of said valve assembly and said proximate end of said flexible tube is axially retained within said valve assembly between said flexible diaphragm and said valve housing;

said flexible tube being slidable relative to said valve housing between a first position wherein said proximate end contacts said flexible diaphragm thereby preventing beverage flow past said diaphragm and a second position wherein said proximate end is spaced from said flexible diaphragm thereby allowing beverage present in said container to flow out of said container through said valve assembly and through said flexible tube when sucking action is exerted by a user on the distal end of said flexible tube.

5. A consumable beverage dispenser as defined in claim 4, wherein said valve assembly is adjacent said opening.

6. A consumable beverage dispenser as defined in claim 5, further comprising a retaining member operably connecting said flexible diaphragm to said valve seat and wherein said valve housing defines at least one detent and said proximate end of said flexible tube defines at least one protrusion for maintaining said flexible tube in the second position by cooperative engagement with said detent and one receiving cavity for maintaining said flexible tube in the first position by cooperative engagement with said retaining member.

7. A consumable beverage dispenser as defined in claim 6 wherein said protrusion and said detent are annular.

8. A consumable beverage dispenser as defined in claim 6 wherein said flexible tube defines a central passageway and wherein said receiving cavity is in communication with said central passageway.

9. A consumable beverage dispenser as defined in claim 5 wherein said valve assembly further comprises a spacing member extending into said collapsible container, wherein said spacing member prevents said collapsible container from blocking the outward flow of beverage through said valve assembly as beverage is withdrawn and said collapsible container collapses.

10. A consumable beverage dispenser as defined in claim 9 wherein said spacing member comprises a generally semicircular member perpendicular to said flexible diaphragm, said spacing member defining a first surface, a second surface, and a periphery defining at least one notch, and wherein each of said first and second surfaces defines at least one elongate raised area protruding therefrom.

11. A consumable beverage dispenser as defined in claim 4 wherein said flexible tube retains its position after being bent into a desired position.

12. A consumable beverage dispenser as defined in claim 5, further comprising a rigid outer container enclosing said collapsible beverage container, said rigid outer container defining at least one hole through which at least a portion of said valve assembly extends.

13. A sealing and dispensing closure for an outlet opening of a package containing a consumable beverage or other liquid, said closure comprising:

a valve assembly in communication with the outlet opening, said valve assembly comprising a valve seat, a valve housing having a hole therethrough, and a flexible diaphragm disposed on said valve seat within said valve housing and permitting beverage flow only outwardly from said package; and a flexible tube having a distal end and a proximate end and being slidably received in the hole in said valve housing such that said distal end of said flexible tube is outside of said valve assembly and said proximate end of said flexible tube is axially retained within said valve assembly between said flexible diaphragm and said valve housing;

said flexible tube being slidable relative to said valve housing between a first position wherein said proximate end contacts said flexible diaphragm thereby preventing beverage flow past said diaphragm and a second position wherein said proximate end is spaced from said flexible diaphragm thereby allowing beverage present in the package to flow out of the package through said valve assembly and through said flexible tube when sucking action is exerted by a user on the distal end of said flexible tube.

14. A sealing and dispensing closure as defined in claim 13, further comprising a retaining member operably connecting said flexible diaphragm to said valve seat, and wherein said valve housing defines at least one detent and said proximate end of said flexible tube defines at least one protrusion for maintaining said flexible tube in the second position by cooperative engagement with said detent and one receiving cavity for maintaining said flexible tube in the first position by cooperative engagement with said retaining member.

15. A sealing and dispensing closure as defined in claim 14 wherein said protrusion and said detent are annular.

16. A sealing and dispensing closure as defined in claim 14 wherein said flexible tube defines a central passageway and wherein said receiving cavity is in communication with said central passageway.

17. A sealing and dispensing closure as defined in claim 13 wherein said valve assembly further comprises a spacing member extending into the package.

18. A sealing and dispensing closure as defined in claim 17 wherein said spacing member comprises a generally semicircular member perpendicular to said flexible diaphragm, said spacing member defining a first surface, a second surface, and a periphery defining at least one notch, and wherein each of said first and second surfaces defines at least one elongate raised area protruding therefrom.

19. A sealing and dispensing closure as defined in claim 13 wherein said flexible tube retains its position after being bent into a desired position.

* * * * *